United States Patent [19]

Livesey et al.

[11] Patent Number: 4,604,073

[45] Date of Patent: Aug. 5, 1986

[54] TAKE-APART ROCKING STACK TOY

[75] Inventors: James R. Livesey, Fountain Valley; William Hart, Palos Verdes Estates; Harold A. Hartleben, Los Angeles, all of Calif.

[73] Assignee: Mattel, Inc., Hawthorne, Calif.

[21] Appl. No.: 683,736

[22] Filed: Dec. 19, 1984

[51] Int. Cl.[4] ..... A63H 33/04; A63H 13/38

[52] U.S. Cl. ..... 446/117; 446/396

[58] Field of Search ..... 446/117, 325, 326, 97, 446/116, 120, 121, 122, 396, 69, 77, 70

[56] References Cited

U.S. PATENT DOCUMENTS

| | | | |
|---|---|---|---|
| 264,066 | 9/1882 | Crandall | 446/117 X |
| 298,633 | 5/1884 | Snow | 446/117 |
| 2,278,894 | 4/1942 | Paulson | 446/117 |
| 2,458,306 | 1/1949 | Schneider | 446/97 X |
| 2,475,306 | 7/1949 | Beder | 446/117 |
| 2,839,842 | 6/1958 | Keyko | 434/259 |
| 2,936,544 | 5/1960 | Kohner | 446/117 |
| 2,937,872 | 5/1960 | Gilman | 446/396 X |
| 3,139,698 | 7/1964 | Arnold | 446/97 X |
| 3,159,403 | 12/1964 | Glass et al. | 446/117 X |
| 3,545,798 | 12/1970 | Swett | 446/97 X |
| 3,624,955 | 12/1971 | Matsubayashi et al. | 446/117 |
| 4,129,963 | 12/1978 | Perry, Jr. et al. | 446/325 |
| 4,145,837 | 3/1979 | Weikel | 446/396 X |
| 4,485,585 | 12/1984 | Shackelford et al. | 446/117 X |
| 4,509,920 | 4/1985 | Kaufmann | 446/117 X |

FOREIGN PATENT DOCUMENTS

| | | | |
|---|---|---|---|
| 482946 | 4/1938 | United Kingdom | 446/97 |
| 2098495 | 11/1982 | United Kingdom | 446/117 |

*Primary Examiner*—Robert A. Hafer
*Assistant Examiner*—D. Neal Muir
*Attorney, Agent, or Firm*—Ronald Goldman; Melvin A. Klein; Dan Sullivan

[57] ABSTRACT

A toy including a base portion having a spherically contoured lower surface with a generally flattened portion at the center thereof and an upper surface with a centrally positioned post, and a plurality of other members, each of like configuration, but of different sizes, each being provided on the undersurface thereof with a centrally positioned cup-shaped socket portion configured for generally interlocking with the post, and on the upper surface thereof with a generally centrally positioned post. A figure member is provided with a cup-shaped socket portion in the bottom thereof for engagement with the post of the uppermost other member.

8 Claims, 3 Drawing Figures

20
20d
20c
15b
15a
15
18a
18b
18
14b
14a
14
17a
17b
17
16a
16b
16
26
12a
12
22
10

TAKE-APART ROCKING STACK TOY

BACKGROUND OF THE INVENTION

The background of the invention will be discussed in two parts:

1. Field of the Invention

This invention relates to toys, and more particularly to a toy having a rockable base and stackable interconnecting members.

2. Description of the Prior art

Toys for children, particularly pre-school children, must be durable and simple in use. This is particularly important with toys which are intended to be assembled and disassembled. Safety, likewise is paramount.

A toy intended for assembly and disassembly is shown and described in U.S. Pat. No. 2,475,306, issued July 5, 1949 to Beder. This toy includes a base with an upwardly projecting rod onto which are assembled "jigsaw" like pieces, which when assembled on the rod depict a human or animal form. Such toys using elongate rods are not safe for children of tender years.

Another toy is shown and described in U.S. Pat. No. 3,624,955, entitled "Disc-shaped Blocks with Cylindrical Projections and Concentric Walls", issued Dec. 7, 1971 to Matsubayshi et al. The blocks are cylindrical or frusto-conically configured with the upper surface of each of the blocks having a plurality of upwardly extending projections for keying with mating portions of the undersurface of another block. Such blocks are not suitable for pre-school children.

It is an object of the present invention to provide a new and improved toy which is capable of being asssemble and disassembled.

It is another object of the present invention to provide a new and improved stackable toy for young children.

It is a further object of the present invention to provide a new and improved toy having a base with a rocking surface and stackable like members with a simulated figure for the top portion.

SUMMARY OF THE INVENTION

The foregoing and other objects are accomplished by providing a toy including a base portion having a spherically contoured lower surface with a flattened central portion and an upper surface with a centrally positioned post, and a plurality of other members of like configuration, but of different sizes and weights, each being provided on the undersurface thereof with a centrally positioned cup-shaped socket portion configured for generally interlocking with the post, and on the upper surface thereof with a generally centrally positioned post. A figure member is provided with a cup-shaped socket portion in the bottom thereof for engagement with the post of the uppermost other member.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
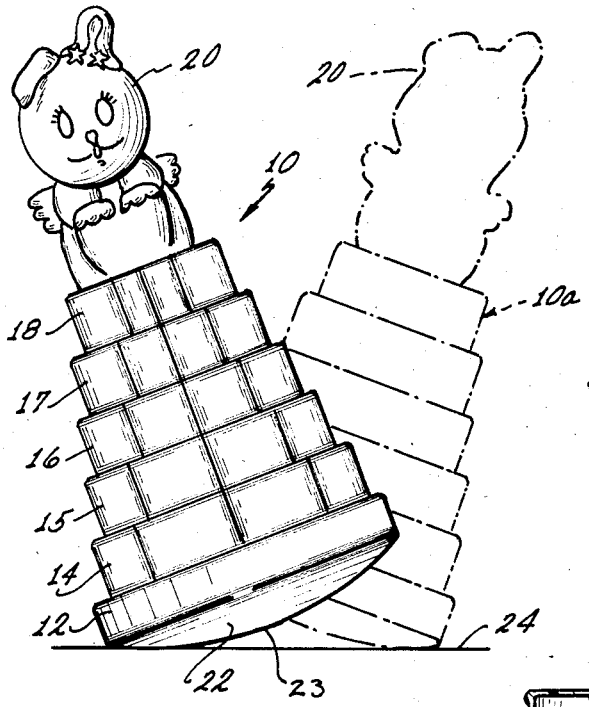
FIG. 1 is a front elevational view of the toy according to the present invention.

Referring now to the drawings, and particularly FIG. 1 there is shown a toy, generally designated 10, which is particularly suited for children of tender years, the toy 10 having a base 12, a plurality of other members 14 through 18, inclusive, and a figure member 20. The base 12 is formed with a spherically contoured surface 22 for rocking on a surface 24. At the center of the surface 22, the base 12 is provided with a flattened portion 23 to provide stability to the toy 10. As shown in FIG. 1, with the various parts in assembled relation, a child, in addition to the amusement and entertainment provided by assembly and disassembly, is provided with the amusement which comes from rocking the toy 10 from the solid line position to the dotted line position designated 10*a*, in FIG. 1.

By referring to FIGS. 2 and 3, the details of construction of the toy 10 will be described. Initially, since the toy is intended for pre-school children, the components should preferably be lightweight, and, as shown in FIG. 1, the base 12 and the other members 14–18 are preferably formed of a molded polyethylene material in a generally hollow configuration.

To provide additional play value for the toy 10, the figure member 20 is preferably formed of a soft resilient plastisol material and may be used in the same manner as a doll, without the use of the other members, if so desired.

The base 12 has the lower surface 22 thereof configured as a spherically contoured surface with the flattened portion 23 at the center part thereof, with the upper surface 26 being generally circular and planar and having intergrally formed therewith an upwardly extending generally centrally positioned post 12*a*. The lower surface contour is that of a sphere of approximately 6 inch spherical radius for stability.

Each of the other members 14 through 18 has generally parallel upper and lower surfaces, with the upper surfaces provided with posts configured generally identically to the post 12*a*. For example, member 16 has the post 16*a* formed in the upper surface 16*b*, this surface being generally parallel to the lower surface 16*c*, which has generally centrally formed therein a cupshaped socket portion 16*d*. The cup-shaped socket portion 16*d* is matingly configured for interaction and interlocks with a corresponding post, such as any of the posts 12*a*, 13*a*, 14*a*, and 15*a* or the like. The frictional engagment of a post within a cup-shaped socket portion is preferably slight for use by small children.

Figure 2:
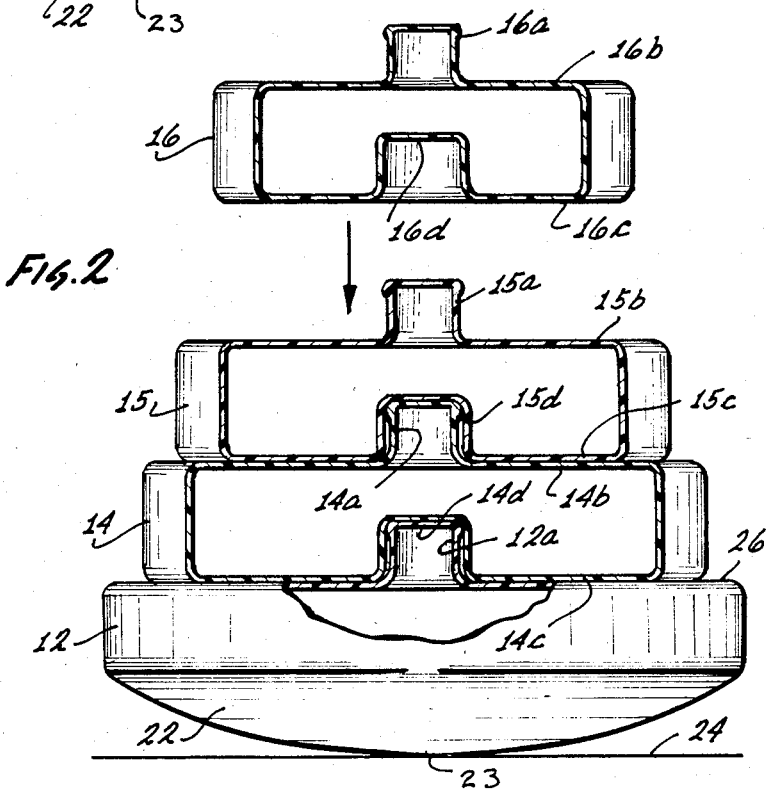
FIG. 2 is a front view, partly exploded, partially broken away, and partially in cross-section of the base and the other members of the toy of FIG. 1.
Figure 3:
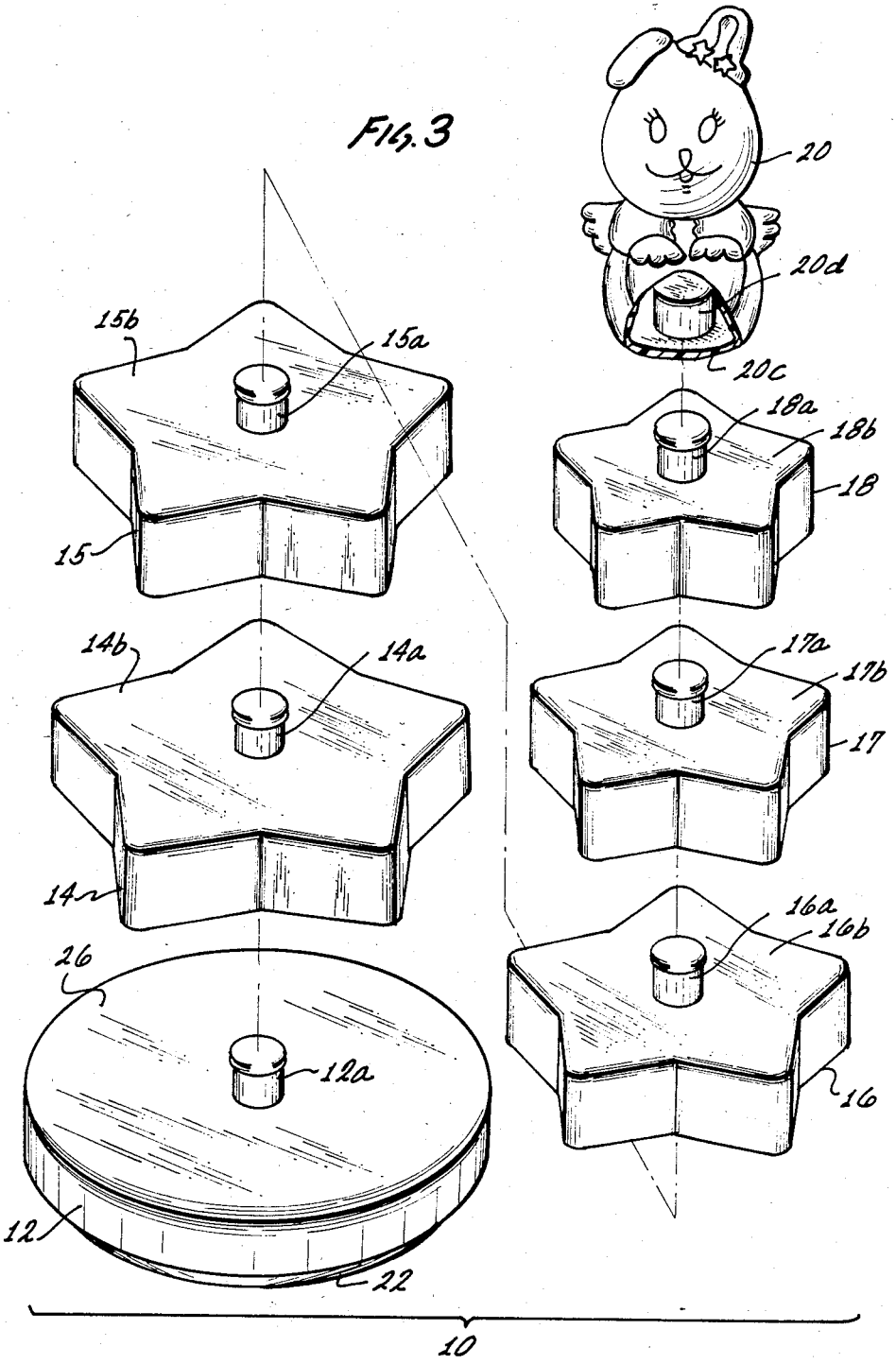
FIG. 3 is an exploded perspective view of the toy of FIG. 1 illustrating an assembly arrangement.

As illustrated in FIGS. 2 and 3, each of the members 14 through 18 is, in appearance, generally identically configured, with each member being slightly smaller in overall size than a corresponding lower member, thereby permitting creation by the child of a pyramid configuration, as depicted in FIG. 1.

To assist in promoting stability of the toy 10 during play, in addition to each of the members 14 through 18 from bottom to top being smaller in overall size, the wall thickness of the members are graduated in size, with the upper members having a lesser wall thickness, and consequently lesser weight for the member. By way of example only, the base 12 has a wall thickness of 0.120 inch, with members 14 and 15 having a wall thickness of about 0.090 inch and members 16 through 18, inclusive having a wall thickness of 0.080 inch. This reduction in wall thickness of the upper members lowers the center of gravity of the assembled toy 10, enabling the toy 10 to return to a central rest position, over the flattened center portion 23, after being rocked.

As shown in FIG. 3, figure member 20 is preferably molded as a generally hollow member and has a generally planar base portion 20*c* with a generally centrally located cup-shaped socket portion 20*d* formed therein for mating coaction with any of the posts 12*a*–18*a*. As previously described, the figure member 20 is preferably formed of a soft resilient material, such as a plastisol.

As illustrated in FIG. 3, the members 14–18 are geometrically configured in the form of "stars" with the figure member 20 formed in the appearance of an angel, these particular configurations being matters of choice, and not necessarily forming a part of the invention.

In accordance with the invention, the members 14–18 may be stacked upon one another in descending size order as shown, or one or more may be omitted, or the order may be changed during stacking. In any event, the figure member 20 may be interlocked with the upper member, or the base itself if desired.

While the relative positions of the posts and cup-shaped socket portions may be interchanged, by having a post 12*a* on the base 12, the ease with which a child may assemble the parts is facilitated. Correspondingly, if the posts and cup-shaped socket portions were reversed, the figure member 20 would have a post depending therefrom, which would preclude its ability for standing upright on a surface independent of the other parts.

In accordance with the invention, the members 14 through 18 are both graduated in decreasing size and in decreasing weight from bottom to top to facilitate use by a child of tender years, with the flattened portion 23 of the base 12 promoting a centrally stable position at rest.

While there has been shown and described a preferred embodiment, it is to be understood that various other adaptations and modifications may be made within the spirit and scope of the invention.

We claim:

1. In a toy, the combination comprising:

a hollow base member having a generally spherically shaped bottom surface means configured for rocking engagement with a supporting surface and an upper generally planar surface having a generally centrally located upwardly extending post means formed integrally therewith for providing a coupling extension, said generally spherically shaped bottom surface means including a substantially spherically shaped surface and generally centrally located substantially flattened portion on said substantially spherically shaped surface;

a plurality of other hollow members, each of said other hollow members having generally parallel surfaces, one of said surfaces having a generally centrally positioned post means extending therefrom for providing a coupling extension configured generally identical to the post means of said hollow base member, and the other of said surfaces having formed generally centrally therein a generally cup-shaped socket means configured for mating engagement with one of said post means and removably stacking each of said other hollow members to another of said other hollow members in order to allow a number of said other hollow members to be supported on said hollow base member and rocked by said spherically shaped bottom surface means; and a figure member having a base portion with a generally cup-shaped socket means formed therein for mating engagement with one of said post means and removeably assembling said plurality of other hollow members in generally interlocking relation, said hollow base member having a wall thickness greater than the wall thickness of each of said other hollow members, said wall thickness of said other hollow members varying in size so that at least two of said other hollow members have different size wall thickness and said other hollow members are capable of being stacked upon one another in order of descending wall thickness size.

2. The combination according to claim 1 wherein each of said other hollow members has a generally identical configuration in appearance, but at least two of said other hollow members are of different sizes for enabling formation of a pyramid like structure.

3. The combination according to claim 2 wherein each of said other hollow members is in the form of a geometrical figure.

4. The combination according to claim 1 wherein said figure member is generally hollow and formed of a generally flexible material.

5. The combination according to claim 4 wherein said hollow base member and said other hollow members are formed of a generally lightweight material.

6. the combination according to claim 3 wherein said figure member, said hollow base member and said other hollow members are formed of a generally lightweight material.

7. In a toy, the combination comprising:

a hollow base member having a generally spherically shaped bottom surface means configured for rocking engagement with a supporting surface and an upper generally planar surface having a generally centrally located upwardly extending post means formed integrally therewith for providing a coupling extension, said generally spherically shaped bottom surface means including a substantially spherically shaped surface and a generally centrally located substantially flattened portion on said substantially spherically shaped surface;

a plurality of other hollow members, each of said plurality of other hollow members being of similar overall configuration but of different sizes adapted for stacking upon one another in order of descending size, each of said other hollow members having generally parallel surfaces, one of said surfaces having a generally centrally positioned post means extending therefrom for providing a coupling extension configured generally identical to the post means of said hollow base member, and the other of said surfaces having formed generally centrally therein a generally cup-shaped socket means configured for mating engagement with one of said post means and removeably stacking each of said other hollow members to another of said other hollow members in order to allow a number of said other hollow members to be supported on said hollow base member and rocked by said spherically shaped bottom surface means; and a figure member having a base portion with a generally cup-shaped socket means formed therein for mating engagement with one of said post means and removably assembling said plurality of other hollow members in generally interlocking relation, said hollow base member having a wall thickness greater than the wall thickness of each of said other hollow members, said wall thickness of said other hollow members varying in size so that at least two of said other hollow members have different size wall thickness and said other hollow members are capable of being stacked upon one another in order of descending wall thickness size.

8. The combination according to claim 7 wherein said Figure member is hollow and said figure member, hollow base member and other hollow members are made out of a generally lightweight material.

* * * * *